US007991306B2

(12) United States Patent
Shibaki

(10) Patent No.: US 7,991,306 B2
(45) Date of Patent: Aug. 2, 2011

(54) SHEET TRANSPORT APPARATUS AND IMAGE FORMING APPARATUS

(75) Inventor: Seiji Shibaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 263 days.

(21) Appl. No.: 11/468,564

(22) Filed: Aug. 30, 2006

(65) Prior Publication Data

US 2007/0047978 A1 Mar. 1, 2007

(30) Foreign Application Priority Data

Sep. 1, 2005 (JP) ..... 2005-254190

(51) Int. Cl.
*G03G 15/00* (2006.01)

(52) U.S. Cl. ..... 399/16; 271/3.15

(58) Field of Classification Search ..... 399/16
See application file for complete search history.

(56) References Cited

U.S. PATENT DOCUMENTS

| | | | | |
|---|---|---|---|---|
| 5,197,726 | A | 3/1993 | Nogami | |
| 5,278,622 | A * | 1/1994 | Segawa | 399/371 |
| 5,450,116 | A * | 9/1995 | Weiselfish et al. | 347/171 |
| 6,168,333 | B1 * | 1/2001 | Merz et al. | 400/634 |
| 6,374,075 | B1 * | 4/2002 | Benedict et al. | 399/395 |
| 6,519,443 | B1 * | 2/2003 | Coriale et al. | 399/388 |
| 6,572,096 | B1 * | 6/2003 | Johnson et al. | 271/25 |
| 7,104,710 | B2 | 9/2006 | Otsuka | |
| 2005/0053408 | A1 | 3/2005 | Otsuka | |
| 2005/0082739 | A1 * | 4/2005 | Mitsuya et al. | 271/10.11 |

FOREIGN PATENT DOCUMENTS

| | | | |
|---|---|---|---|
| JP | 61-051429 | | 3/1986 |
| JP | 62095281 | A * | 5/1987 |
| JP | S64-017737 | | 1/1989 |
| JP | H03-119854 | | 12/1991 |
| JP | H05-085644 | | 4/1993 |
| JP | 5-319630 | | 12/1993 |
| JP | H06-016262 | | 1/1994 |
| JP | 2005-082289 | | 3/2005 |
| JP | 2005-193990 | | 7/2005 |

* cited by examiner

*Primary Examiner* — Ren Yan
*Assistant Examiner* — Allister Primo
(74) *Attorney, Agent, or Firm* — Fitzpatrick, Cella, Harper & Scinto

(57) ABSTRACT

A sheet transport apparatus of the present invention includes sheet transport means that transports a sheet, an actual position detecting device that detects an actual position of the sheet based on the rotation of a rotating member that is driven to rotate by the sheet transported by the sheet transport means, and a controller that controls a sheet transport speed of the sheet transport means depending on a difference between the actual position of the sheet which is detected by the actual position detecting device and a predicted position of the sheet which is calculated based on the sheet transport speed of the sheet transport means.

6 Claims, 9 Drawing Sheets

SHEET TRANSPORT APPARATUS AND IMAGE FORMING APPARATUS

BACKGROUND OF THE INVENTION

1. Field of the Invention

The present invention relates to a sheet transport apparatus that transports a sheet and to an image forming apparatus that has such a sheet transport apparatus in an apparatus body thereof and forms an image on a sheet transported from the sheet transport apparatus.

2. Description of the Related Art

Conventionally, a sheet handling apparatus that handles a sheet, such as an image forming apparatus that forms an image on a sheet, a sheet processing apparatus that processes the sheet and the like, has a sheet transport apparatus that transports a sheet. Examples of an image forming apparatus include a copying machine, a printer, a facsimile and a combined machine thereof. Examples of a sheet processing apparatus include a sheet binding device that binds a sheet bundle, a punching device that punches a sheet and a folding device that folds a sheet bundle.

Conventionally, in the sheet transport apparatus, when a roller transports a sheet from a sheet holding portion such as a cassette, the roller may sometimes slip on the sheet. When sheets are continuously discharged, the sheet transport apparatus cannot therefore sometimes maintain regular intervals between the sheets. The slippage is caused by a variation of the friction coefficient of the roller due to aging, a difference in the friction coefficients of the sheets due to the different qualities of materials of the sheets and the like.

An example of a sheet transport apparatus that addresses the above-described problem is described in Japanese Patent Application Laid-Open No. H05-319630. FIG. 9 is a schematic drawing of a sheet transport apparatus described in Japanese Patent Application Laid-Open No. H05-319630. In a sheet transport apparatus 1, a sheet is transported to paired rollers 7 and is temporarily stopped with the sheet inserted between the paired rollers 7. After a predetermined time elapses from the start of discharge operation of the sheet, the transport of the sheet is again started from the position of the paired rollers 7. Thus, if the sheet is delayed due to the slippage of a pickup roller 2 corresponding to the above-described roller, the conventional sheet transport apparatus 1 recovers the delay, thereby reducing variations in transport.

Also, the conventional sheet transport apparatus 1 is incorporated in an image forming apparatus that forms an image on a sheet in an image forming portion 15. In the sheet transport apparatus 1, therefore, on the assumption that any slippage occurs in the pickup roller 2 when the sheet is discharged, the sheet is discharged at a higher sheet transport speed V2 than a sheet transport speed V1 of the image forming portion 15. The sheet is temporarily stopped at the paired rollers 7 and after the restart the sheet is discharged at the same sheet transport speed as the sheet transport speed V1 of the image forming portion 15. In this way, the sheet transport apparatus 1 prevents the image forming efficiency of the image forming apparatus from decreasing.

In addition, in order to detect the position of the sheet when the sheet is temporarily stopped at the paired rollers 7 that are in a predetermined position, an elapsed time after the sheet passes a sensor 9 serving as a reference is measured using a timer and a stop position (=speed×time) is calculated in a calculation portion. When a control portion determines that the sheet is transported to the stop position, the control portion causes the paired rollers 7 to stop rotating with the sheet inserted between the paired rollers 7. That is, the sheet stops when the leading end of the sheet protrudes from the paired rollers 7 to the downstream side of the sheet transport direction.

If there are no slippage of the pickup roller 2 and no delay of the sheet, however, the conventional sheet transport apparatus 1 then transports the sheet to the paired rollers 7 at an earlier timing, causes the sheet to stand by at that position for a predetermined time, and again transport the sheet. The stop time is thus extended by the early arrival time of the sheet at the paired rollers 7, resulting in a lower sheet transport efficiency.

Accordingly, the conventional sheet transport apparatus transports the sheet to the paired rollers 7 at a higher speed to increase the sheet transport efficiency. This results in, however, that vibrations of the machinery that transports the sheet and a motor become greater, which causes noise.

Also, an image forming apparatus having a sheet transport apparatus with great vibrations of the machinery that transports the sheet and the motor may possibly be affected by the vibrations, thereby degrading the quality of an image formed on the sheet.

Also, since, in the conventional sheet transport apparatus, the elapsed time after the sheet passes the sensor 9 serving as a reference is measured using a timer to calculate a stop position of the sheet, the assumed speed and time are uneven after the sensor is activated due to the slippage of the paired rollers 7, an error of the timer that measures time, an error due to the delay of software processing and the like. The stop position of the sheet that is inserted in the paired rollers 7 and stopped is thus uneven. That is, the length to which the sheet protrudes from the paired rollers 7 to the downstream side is uneven. The conventional sheet transport apparatus cannot therefore sometimes transport the sheets with regular intervals when the sheets are continuously transported.

It is an object of the present invention is to provide a sheet transport apparatus that transports a sheet to a predetermined position at a proper timing.

It is an object of the present invention is to provide an image forming apparatus having a sheet transport apparatus with reduced vibrations and an improved quality of an image formed on a sheet.

SUMMARY OF THE INVENTION

A sheet transport apparatus of the present invention includes sheet transport means that transports a sheet a sheet detecting sensor that detects the sheet transported by the sheet transport means an actual position detecting device that detects an actual position of the sheet when a first predetermined time elapses after the sheet detecting sensor detects the sheet controller that controls a sheet transport speed of the sheet transport means depending on a difference between the actual position of the sheet which is determined by the actual position detecting device and a predicted position of the sheet which is calculated based on the sheet transport speed of the sheet transport means and the first predetermined time.

Also, a sheet transport apparatus of the present invention include first sheet transport means that transports a sheet second sheet transport means that transports the sheet transported by the first sheet transport means a sheet detecting sensor that detects the sheet transported by the first sheet transport means an actual position detecting device that detects an actual position of the sheet that is detected by the sheet detecting sensor and being transported by the second sheet transport means a controller that controls the first sheet transport means that transports a subsequent sheet so that a predetermined interval is maintained between the preceding sheet whose actual position is detected by the actual position detecting device and the subsequent sheet.

Also, a sheet transport apparatus of the present invention include sheet transport means that transports a sheet an actual position detecting device that detects an actual position of the sheet based on the rotation of a rotating member that is driven to rotate by the sheet transported by the sheet transport means a controller that controls a sheet transport speed of the sheet transport means depending on a difference between the actual position of the sheet which is detected by the actual position detecting device and a predicted position of the sheet which is calculated based on the sheet transport speed of the sheet transport means.

Further features of the present invention will become apparent from the following description of exemplary embodiments with reference to the attached drawings.

DESCRIPTION OF THE EMBODIMENTS

Figure 1:
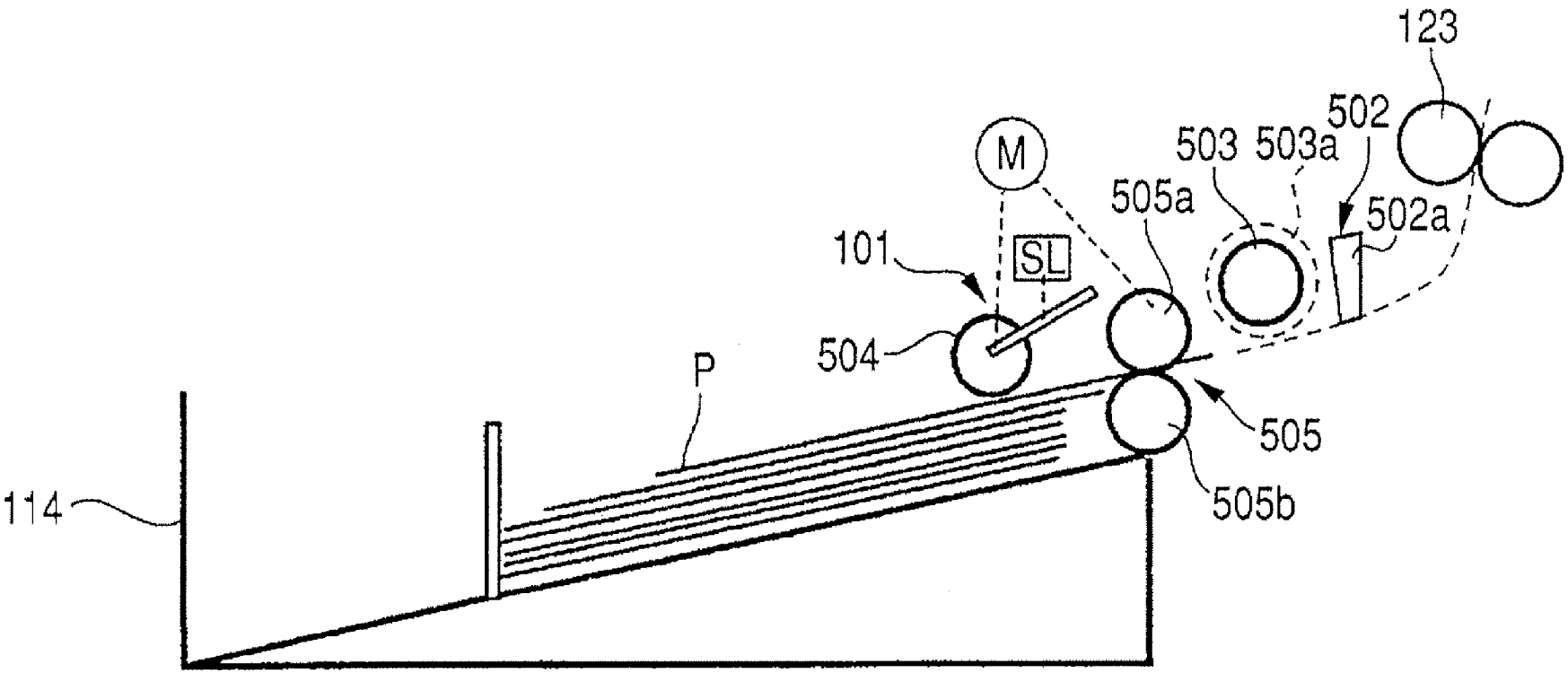
FIG. 1 is a cross-sectional view of a sheet transport apparatus along a sheet transport direction in an embodiment of the present invention.

A sheet transport apparatus and an image forming apparatus having the sheet transport apparatus of an embodiment of the present invention are described below with reference to the drawings.

In addition, the sheet transport apparatus is intended to be provided in a sheet handling apparatus that handles a sheet, such as an image forming apparatus that forms an image on a sheet and a sheet processing apparatus that processes the sheet, and is not intended to be provided only in the image forming apparatus. Examples of an image forming apparatus include a copying machine, a printer, a facsimile, and a combined machine thereof. Examples of a sheet processing apparatus include a sheet binding device that binds a sheet bundle, a punching device that punches a sheet, and a folding device that folds a sheet bundle. Also, in the following description, the values mentioned are reference values and do not limit the present invention.

An image forming apparatus 100 according to an embodiment of the present invention has a document feeder 1000, an image reader 200, a printer 300, and a finisher 500. A sheet transport apparatus 101 of the embodiment of the present invention is provided in the printer 300. In addition, in the following description, the document feeder 1000, the image reader 200 and the printer 300 except for the finisher 500 are collectively referred to as an apparatus body of the image forming apparatus.

Figure 8:
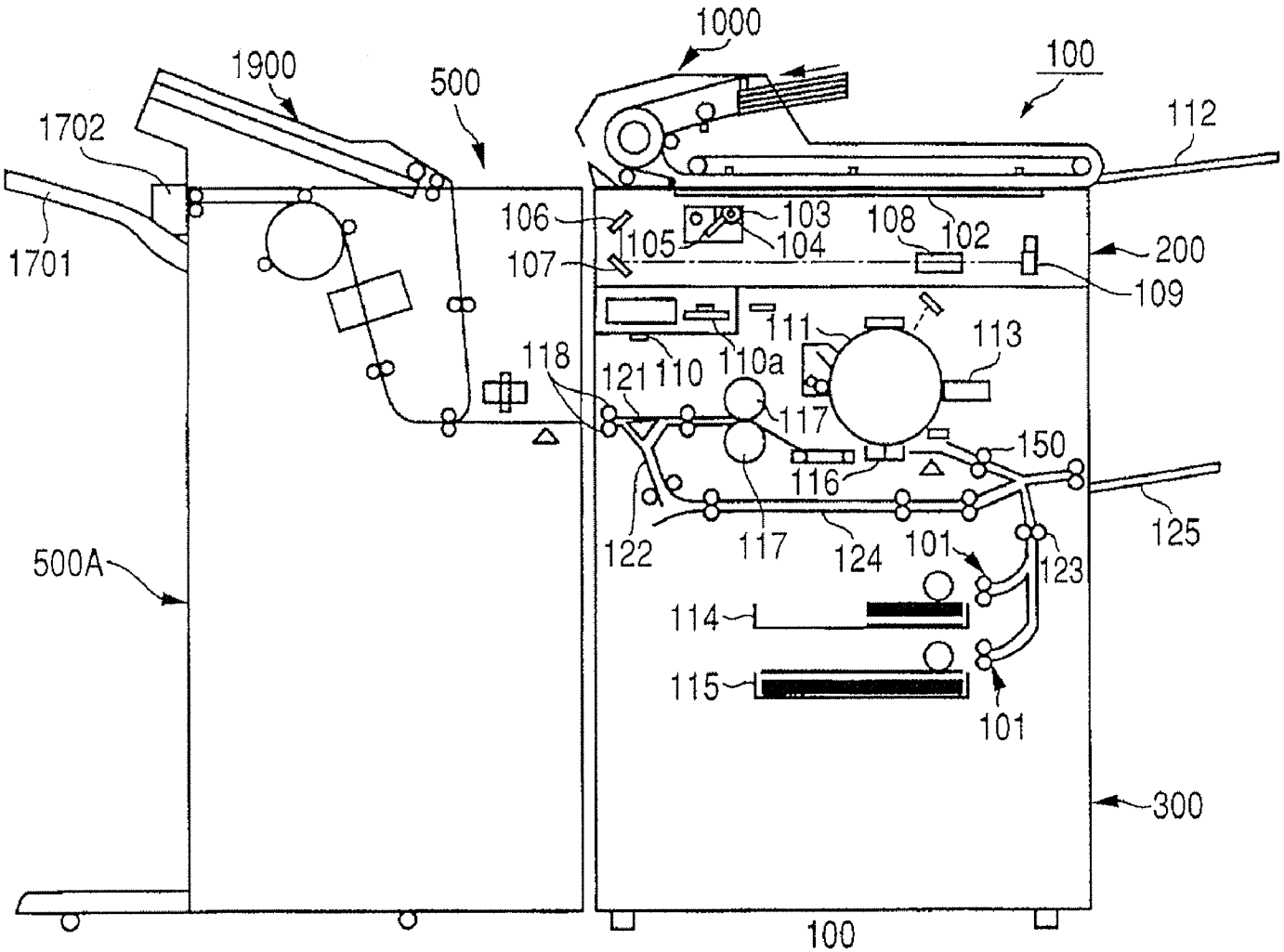
FIG. 8 is a cross-sectional view of the image forming apparatus along a sheet transport direction in the embodiment of the present invention.
Figure 9:
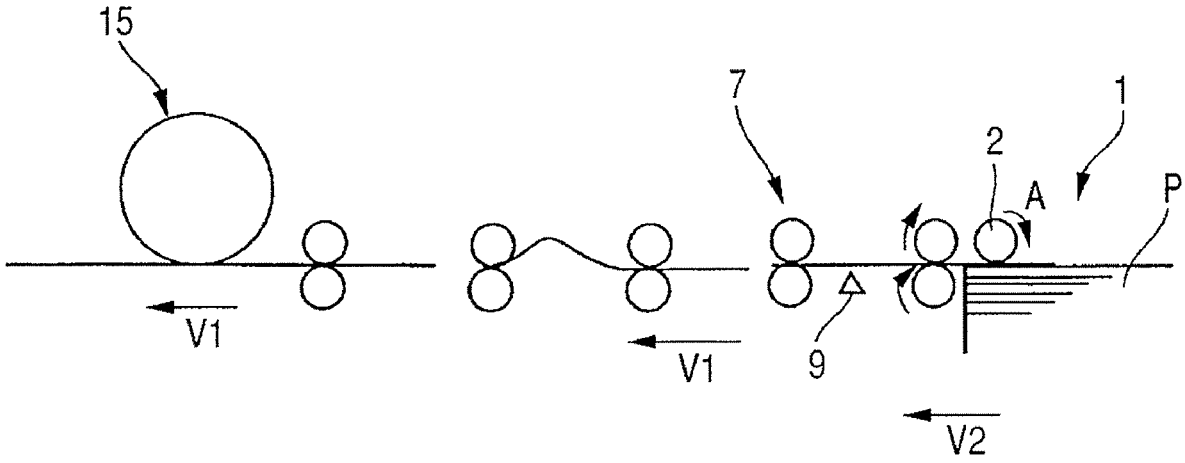
FIG. 9 is a schematic drawing of a conventional sheet transport apparatus.

The document feeder 1000 transports set documents from the first page in sequence one by one through a curved path on a platen glass 102 from the left to the right in FIG. 8 and then discharges the documents to a delivery tray 112. The document then passes from the left to the right above a reader scanner unit 104 that stays in place and is read by the reader scanner unit 104. During the passage of the document, a light of a lamp 103 of the reader scanner unit 104 is applied to the document and a reflected light from the document is led through mirrors 105, 106 and 107 and a lens 108 to an image sensor 109. In addition, the image reader 200 can also read the document by transporting the document on the platen glass 102 by the document feeder 1000, stopping the document and moving the reader scanner unit 104 from the left to the right.

An image of the document read by the image sensor 109 is subjected to image processing in an image processing portion 806 (see FIG. 2) and is sent as image data to an exposure control portion 110. The exposure control portion 110 that receives the image data applies a laser light to a photoconductor drum 111. An electrostatic latent image is formed on the photoconductor drum 111 by the laser light. The electrostatic latent image on the photoconductor drum 111 is toner-developed by a developing portion 113 to provide a toner image. The toner image on the photoconductor drum 111 is transferred by a transfer portion 116 on a sheet fed from any of cassettes 114 and 115, a manual sheet feeding portion 125 and a double side transport path 124. The photoconductor drum 111, the developing portion 113 and the like constitute image forming means.

The sheet is corrected for any bias to be straight by paired resist rollers 150 and is then fed between the photoconductor drum 111 and the transfer portion 116 in alignment with the position of the toner image of the photoconductor drum 111. Detailed description of the control of feeding of the sheet from the cassette 114, which is a feature of the present invention, is described later.

The toner image transferred on the sheet is fixed by a fixing portion 117. After passing the fixing portion 117, the sheet is once guided by a flapper 121 to a path 122. After the trailing end of the sheet leaves the flapper 121, the sheet is switchback-transported and is led to a discharge roller 118 by the flapper 121. The sheet is thus discharged from the printer 300 by the discharge roller 118 with the side of the sheet having the toner image transferred thereon facing downward (facing down).

In addition, a hard sheet, such as an OHP sheet, is fed from the manual sheet feeding portion 125, is subjected to image formation and image fixation, and is then discharged from the printer 300 by the discharge roller 118 with the side of the sheet having the toner image formed thereon facing upward (facing up), without being led to the path 122. Also, if images are to be formed on both sides of a sheet, the toner image is fixed on one side of the sheet and the sheet is guided from the fixing portion 117 directly to the discharge roller 118. Immediately after the trailing end of the sheet leaves the flapper 121, the sheet is switchback-transported and is reversed. The sheet is then guided by the flapper 121 to the double side transport path 124, where the other side of the sheet is subjected to image formation and image fixation, and the sheet is discharged from the printer 300.

The sheet discharged from the discharge roller 118 is fed into an apparatus body 500A of the finisher 500. The apparatus body 500A of the finisher 500 is adapted to perform at least one of shift processing, binding processing, punching processing and the like. Also, an inserter 1900 is provided on the upper part of the finisher 500 to discharge a cover, an inserting paper and the like of a sheet bundle to the apparatus body 500A. Also, when a sheet such as a soft sheet is shifted to the width direction to be outputted, an alignment plate 1720 aligns the sheet with the depth or front side on a tray 1701 by moving the sheet perpendicular to the sheet transport direction.

Figure 2:
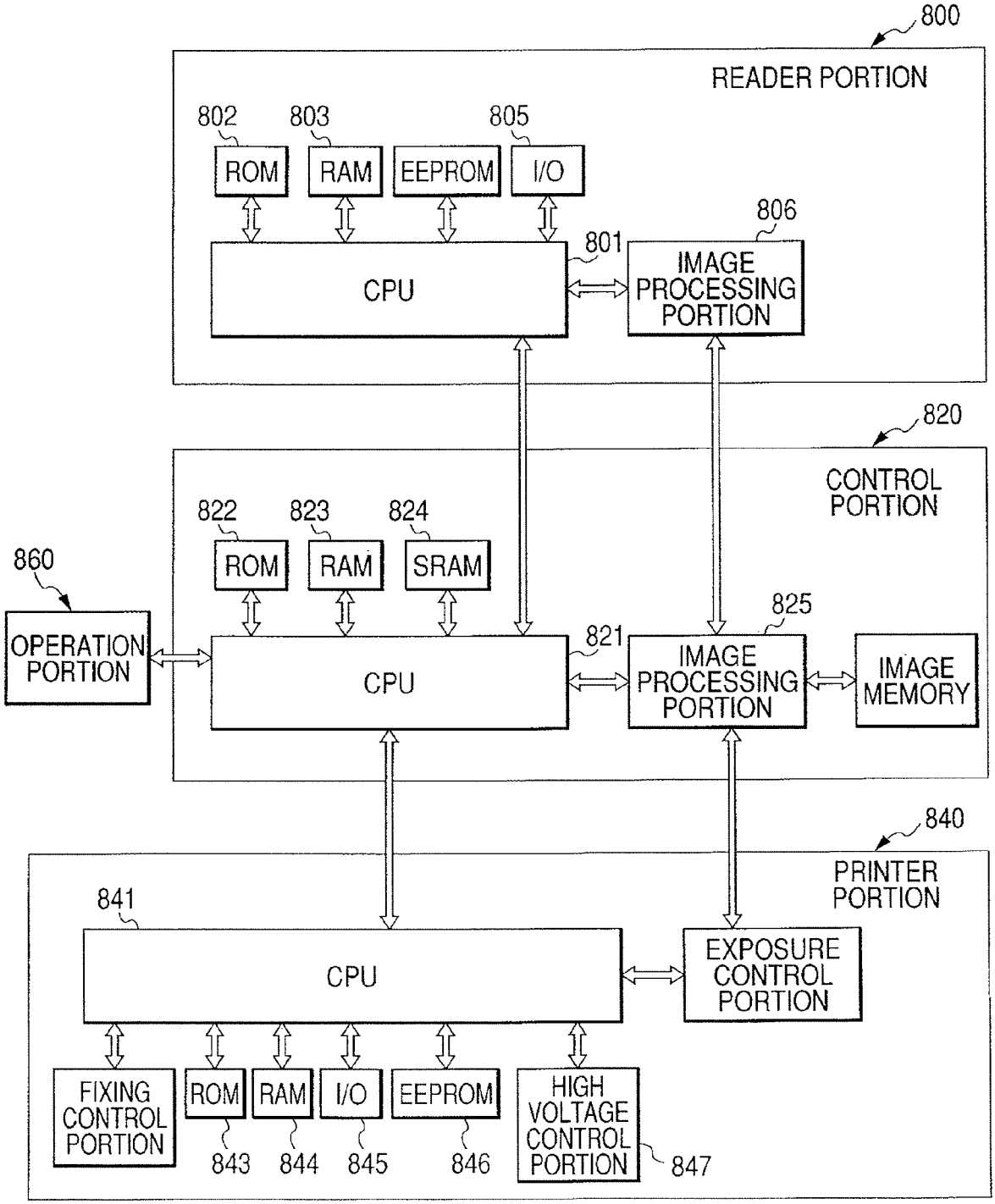
FIG. 2 is a control block diagram of an apparatus body of an image forming apparatus in the embodiment of the present invention.

FIG. 2 is a control block diagram of an image forming apparatus 100. A reader portion 800 is a processing portion that performs control of the document feeder 1000 and the image reader 200, which mainly performs transport of documents and reading of images. A central processing unit (hereinafter referred to as a "CPU") 801 performs control of the entire reader portion 800. A read only memory (hereinafter referred to as a "ROM") 802 is a portion that has control procedures (control programs) of the document feeder 1000 and the image reader 200 prestored therein. The CPU 801 controls the components of the document feeder 1000 and the image reader 200 according to the control procedures stored on the ROM 802.

A random access memory (hereinafter referred to as a "RAM") 803 is a main storage used for storage of input data and as a working memory area and the like. An input/output IC (hereinafter referred to as a "I/O") 805 receives and sends to the CPU 801 an output of a control signal of the CPU 801 to a load of a motor and the like and a signal from a sensor and the like. An image processing portion 806 performs shading correction to image data read by the image sensor 109 and performs control to transmit the corrected image data to a control portion 820 as described later.

The control portion 820 is adapted to perform control of the apparatus body of the image forming apparatus while issuing instructions to the reader portion 800 and a printer portion 840. A CPU 821 performs control of the apparatus body of the image forming apparatus. A ROM 822 is a memory that has a control procedure (control program) of the apparatus body of the image forming apparatus stored therein. The CPU 821 performs control of the apparatus body of the image forming apparatus 100 according to the control procedures stored on the ROM 822. A RAM 823 is a main storage used for storage of input data and as a working memory area and the like. The CPU 821 receives input signals from various keys of an operation portion 860 via a bus and an I/O (not shown) and further sends out the signals to display necessary information on a display on the panel. A SRAM 824 is a RAM to retain data that must be retained even after a main power source is turned off, such as adjustment values and total print numbers, and a battery, not shown, is connected to the SRAM 824 and the contents of SRAM 824 are backed up. An image processing portion 825 is a part that processes image data transmitted from the reader portion 800 or an external device, not shown, and performs processing such as scaling, compression and decompression of image data and the like. Also, the image processing portion 825 performs transmission of image data to be printed to the printer portion 840 as described later.

The printer portion 840 is a processing portion that performs control of the printer 300, which mainly performs transport control, high voltage control, fixation control, laser control and the like. A CPU 841 serving as a control portion performs control of the entire printer portion. A ROM 843 is a memory that has control procedures (control programs) of the printer 300 stored therein. The CPU 841 controls the components of the printer 300 according to the control procedures stored on the ROM 843. A RAM 844 is a main storage used for storage of input data and as a working memory area and the like. An I/O 845 receives and sends to the CPU 841 an output of a control signal of the CPU 841 to a load of a motor and the like and a signal from a sensor and the like.

A high voltage control portion 847 is a control portion to output a primary charging output to charge the photosensitive drum 111, a developing bias output to move a toner onto the drum, a transfer current output to transfer the toner on the sheet and the like. The high voltage control portion 847 performs output according to an output level instructed by the CPU 841. Also, the high voltage control portion 847 has an input portion that measures a primary charging output current and a transfer output current, and the measured current values are communicated to the CPU 841 and used for output correction.

The measuring of the primary charging current is performed every 1000 sheets of paper and the measuring of the transfer current is performed every 1100 sheets of paper. An EEPROM 846 has a well-known serial input/output connected to the CPU 841 by a signal line and performs readout and writing of data instructed by a serial command from the CPU 841.

An operation panel (operation portion) is now described with reference to FIG. 3.

Figure 3:
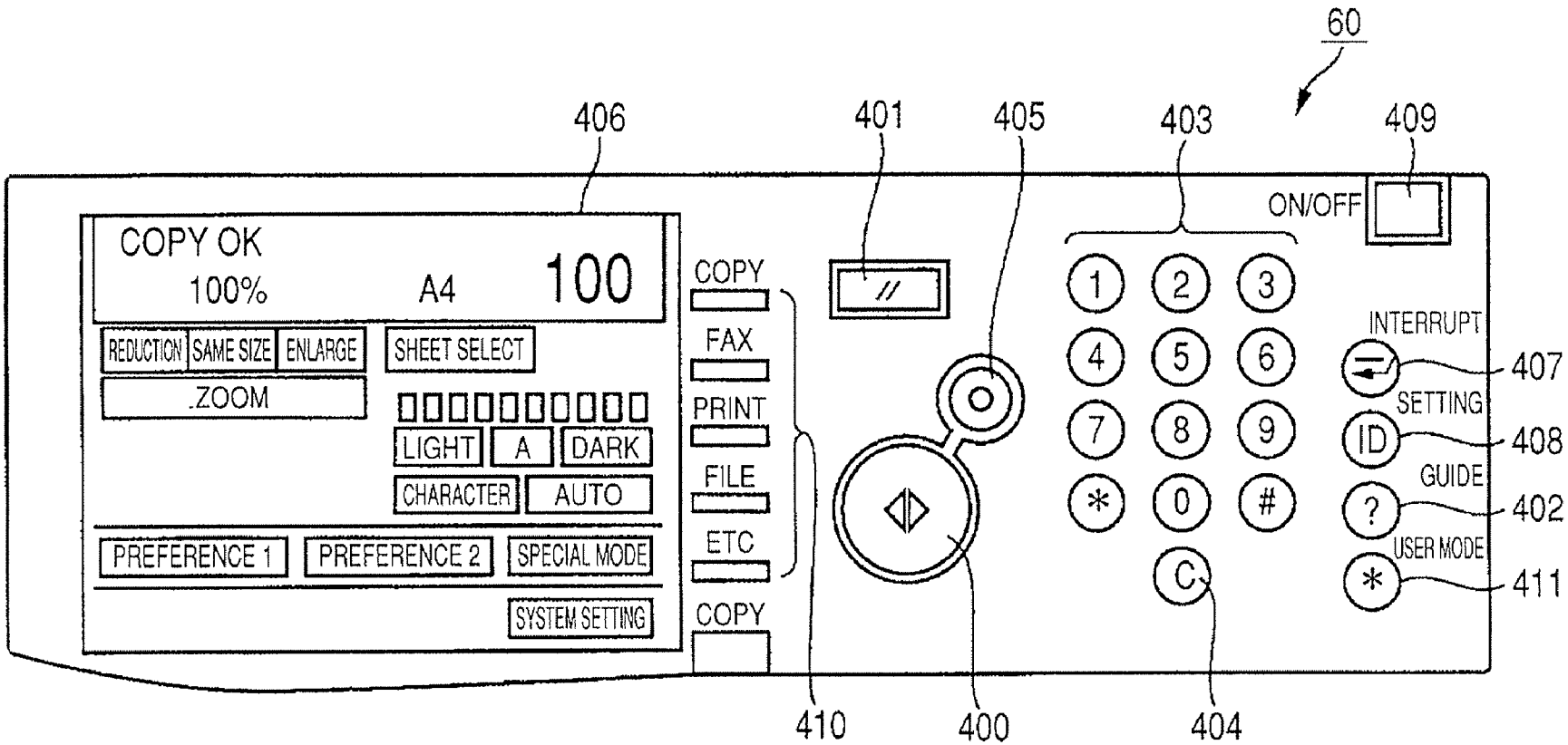
FIG. 3 is an external appearance view of an operation panel.

FIG. 3 is a plan view of an operation panel 60 provided on an image forming apparatus. In FIG. 3, a copy start key 400 is an instruction key for a user to instruct a copy start. A reset key 401 is a key to return to a normal mode. A guidance key 402 is a key depressed by the user to use a guidance function. A ten key 403 is a key to input numerical values, such as the set number of sheets. A clear key 404 is a key to clear the numerical values. A stop key 405 is a key to stop copying in the middle of continuous copying. A liquid crystal display portion and touch panel 406 is a portion that displays settings of various modes, such as a staple mode, a binding mode or double side print setting, and a condition of a printer. An interrupt key 407 is a key to interrupt in the middle of continuous copying or in the middle of use as a facsimile or printer and to make an emergency copy. A secret key 408 is a key to manage the number of copies for each individual or department. A soft switch 409 is a switch to switch on and off the image forming apparatus body. A function key 410 is a key used to change the functions of the image forming apparatus. A user mode key 411 is a key to enter a user mode for the user to preset items, such as an on/off selection of an automatic cassette change and a change of the set time before an energy saving mode is entered.

A sheet transport apparatus 101 is described with reference to FIGS. 1 to 7.

FIG. 1 is a cross-sectional view of a sheet transport apparatus 101 along a sheet transport direction. A sheet P is loaded on a cassette 114. A pickup roller 504 as sheet transport means transports the top (uppermost) sheet P of a sheet bundle set in the cassette 114 to paired sheet feeding rollers 505. The pickup roller 504 is also rotated by a sheet feeding motor M. Also, the pickup roller 504 is moved up and down by a pickup solenoid SL to come out of and in contact with the uppermost sheet.

The paired sheet feeding rollers 505 discharges the sheet P to the outside of the cassette 114. One sheet feeding roller 505*a* of the paired sheet feeding rollers 505 is rotated in such a direction that the sheet P is discharged to the cassette 114 by the sheet feeding motor M. A sheet feeding roller 505*b* is rotated in such a direction that the sheet is returned into the cassette 114 by the sheet feeding motor M via a one-way rotation clutch and a gear, not shown. When one sheet is fed, the sheet feeding roller 505*b* is rotated in accordance with the sheet. When more than one superposed sheets are fed, however, the sheet feeding roller 505*b* reverses to feed backward the superposed sheets into the cassette 114. Although the sheet feeding roller 505*b* receives a rotational force from the sheet feeding motor M in such a direction that the sheet is returned into the cassette 114, the sheet feeding roller 505*b* may be rotated in accordance with the sheet by the one-way rotation clutch.

The pickup roller 504 and the sheet feeding roller 505*a* serving as sheet transport means rotate by the common sheet feeding motor M. When the diameters of both the rollers 504 and 505*a* are different, however, a gear is provided between at least one of the rollers and the sheet feeding motor M so that the circumferential speeds of both the rollers 504 and 505*a* are equal.

A rotary encoder 503 has a rotating member 503*a* that is adjacent to the top face of the transported sheet P. The rotating member 503*a* is driven to rotate by the sheet that is being transported. The rotary encoder 503 generates a pulse signal by the rotating member 503*a* rotating depending on the distance that the sheet P travels. A sheet feeding sensor 502 serving as sheet detecting means is a sensor that responds by the leading end of the sheet P transported by the paired sheet feeding rollers 505 pushing down a flag 502*a* and determines the detection of a jam and the timing at which the rotary encoder 503 starts measuring a distance.

Figure 4:
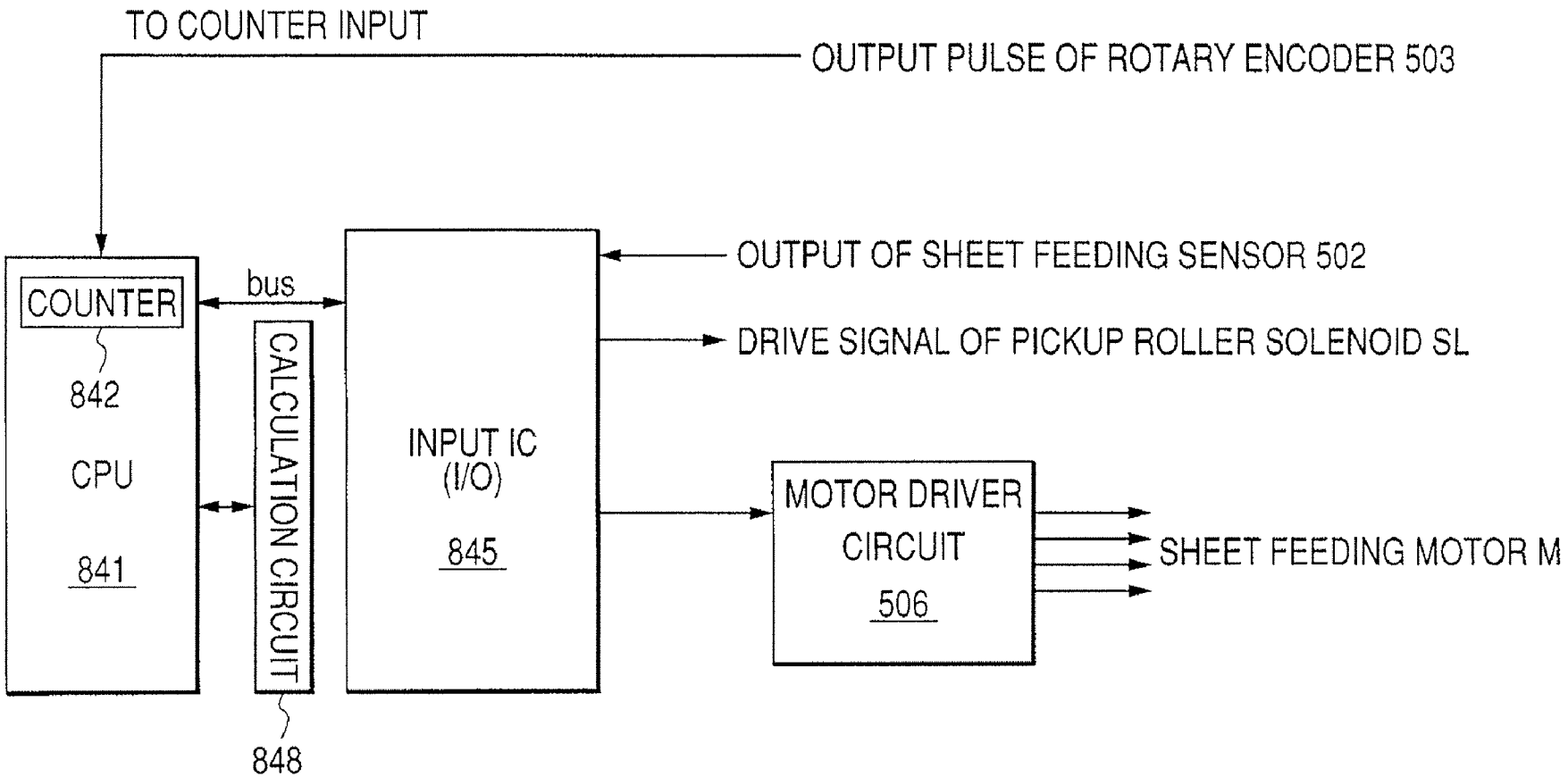
FIG. 4 is a control block diagram concerning a sheet transport apparatus sheet feeding portion of the embodiment of the present invention.

FIG. 4 is a control block diagram showing in detail portions associated with the sheet transport apparatus 101 in the control block diagram of FIG. 2.

A CPU 841 counts pulses outputted from the rotary encoder 503 using a built-in counter (hard counter) 842. Also, the CPU 841 is connected to the I/O 845 by a bus and monitors port output control and an input signal to a port. The I/O 845 also serves to monitor an output of the sheet feeding sensor 502 at an input port. Further, the CPU 841 outputs an output signal to drive the pickup solenoid SL that moves upward and downward the pickup roller 504. Also, the CPU 841 is connected to a motor driver circuit 506 via the I/O 845 and outputs a drive signal to the motor driver circuit 506. The motor driver circuit 506 receives a pulse signal outputted from the I/O 845 and converts the signal to a phase signal to the sheet feeding motor M that is a pulse motor. The phase signal is therefore outputted to the sheet feeding motor M so that the sheet feeding motor M gains one step depending on the change of an on or off signal from the I/O 845.

Figure 5:
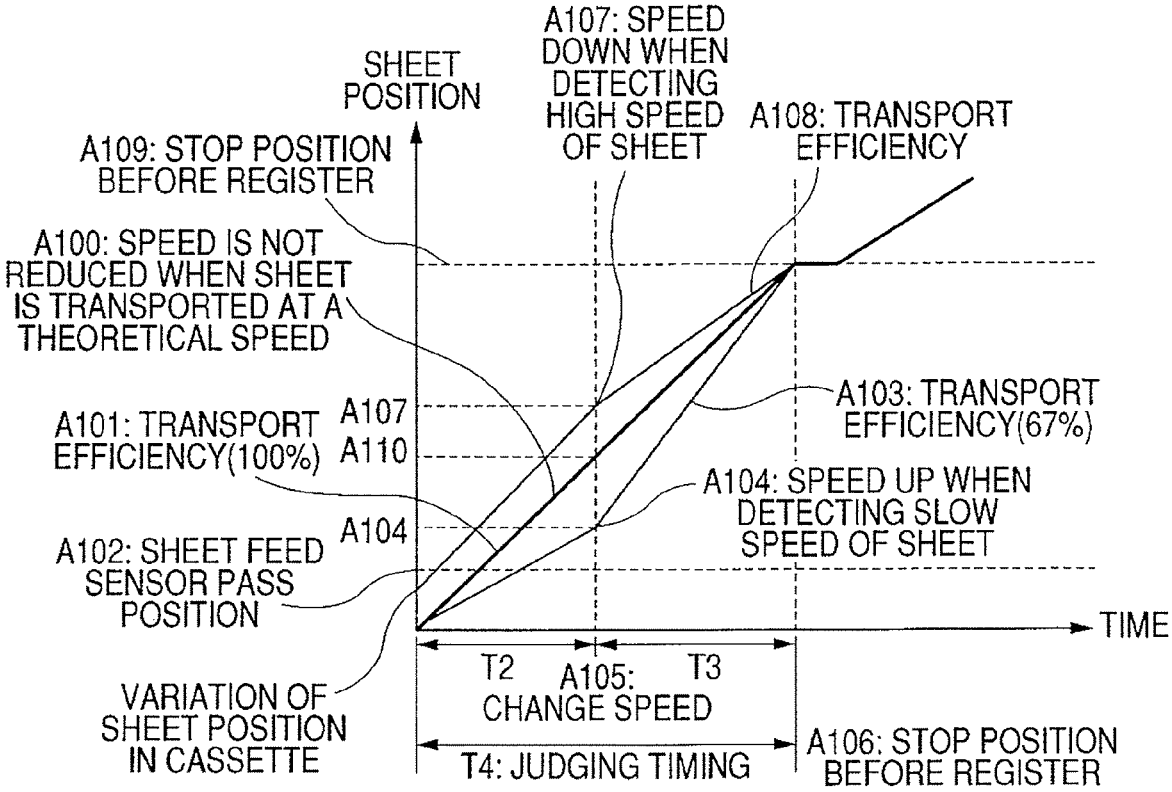
FIG. 5 is a graph showing a lapse of time and a position of a sheet.
Figure 6:
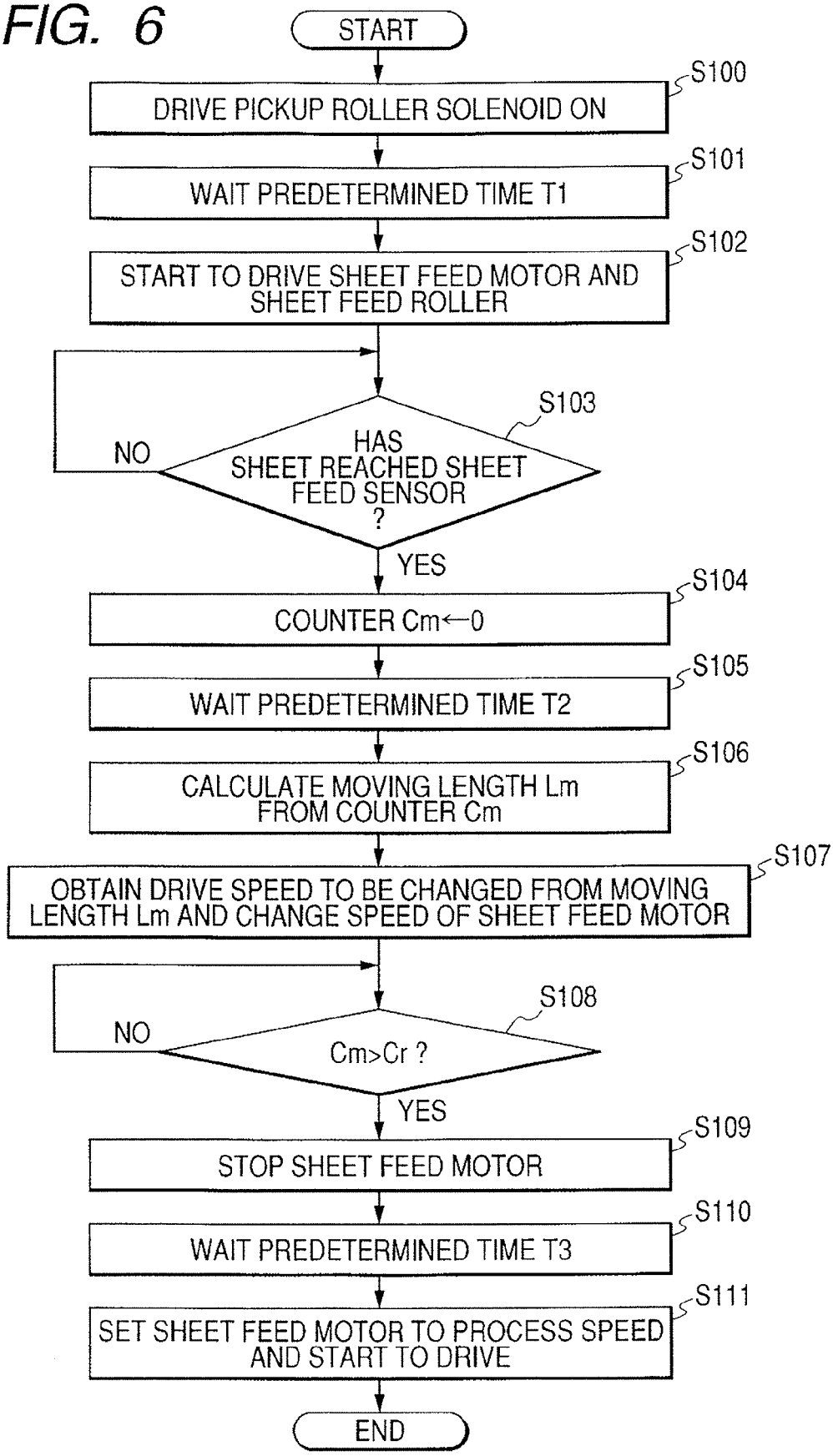
FIG. 6 is a flowchart for operational description in a sheet transport apparatus of the embodiment of the present invention.

An operation sequence of the sheet transport apparatus 101 is described for a sheet transport operation from the start of discharge of a sheet just before the sheet starts being transported to the photoconductor drum 111 using a timing chart of FIG. 5 and a flowchart of FIG. 6.

To start a transport operation of a sheet, the CPU 841 (see FIG. 4) turns on the pickup solenoid SL (see FIG. 1) into operation via the input/output IC 845 (see FIG. 2). The pickup roller 504 then goes down (S100). The CPU 841 then waits for a predetermined time T1 to elapse until the pickup roller 504 goes down to the uppermost sheet (S101), where T1=200 ms.

When the CPU 841 controls the rotation of the sheet feeding motor M via the input/output IC 845 and the motor driver circuit 506, the pickup roller 504 rotates and transports the uppermost sheet to the paired sheet feeding rollers 505. The paired sheet feeding rollers 505 then continuously transport the sheet. The rotary encoder 503 is then caused to start rotating by the transported sheet (S102). In the present embodiment, the sheet transport speed Si is 300 mm/s, which is equal to the circumferential speed of the sheet feeding roller 505*a*.

When the leading end of the sheet then reaches the sheet feeding sensor 502, the sheet feeding sensor 502 turns on by the flag 502*a* being pushed down (S103). When the sheet feeding sensor 502 turns on, the counter 842 built in the CPU 841 is once cleared (Cm=0) and starts counting (S104). The counter 842 counts an output pulse of the rotary encoder 503. The relationship between the circumference of the sheet feeding roller 505*a* and the rotary encoder 503 is such that every time the circumference of the sheet feeding roller 505*a* advances 1 mm, the rotary encoder 503 outputs one pulse.

A process S104 waits T2 after the counter 842 is cleared (S105). The first predetermined time T2 is a timing at which the transport speed is changed, where T2=100 ms. Based on a count value Cm of the counter 842, a calculating circuit 848 calculates a length Lm that the sheet P advances (S106). In addition, the rotary encoder 503, the counter 842 and the calculating circuit 848 constitutes actual position detecting means. The actual position detecting means is used to determine the position of a transported sheet based on the rotation of the rotating member 503*a* rotated by the sheet.

The relationship between Lm and Cm is as follows:

$Lm$ (mm)=$Cm$×a length $Ld$ (mm) that the sheet advances during one pulse.

The CPU 841 then determines a driving speed to be changed from the moving length Lm and changes the speed of the sheet feeding motor M (S107). This corresponds to a speed switching determination timing indicated by a symbol A105 in FIG. 5.

In FIG. 5, a straight line indicated by a symbol A100 is one when the sheet is transported at a theoretical speed from the cassette 114 to an stop position before register, and the position indicated by a symbol A110 is a predicted position of the sheet. In addition, the stop position before register refers to a position on the upstream side of a nip of the paired resist rollers 150 (see FIG. 8).

(The Case where the Transport of a Sheet is Delayed)

A theoretical predicted position indicating the position of a symbol A105 in FIG. 5 can be calculated using the following expression:

Predicted position=sheet transport speed $Si$ (300 mm/S)×elapsed time(first predetermined time $T2$)=300 (mm/S)×0.2 (S)=60 (mm).

Also, if the actual moving length (actual position indicated by a symbol A104 in FIG. 5) Lm that is determined from the count value Cm of the counter 842 is 40 (mm), a delay Ld can be calculated as follows:

60 (mm)−40 (mm)=20 (mm).

It is thus determined that the delay Ld is 20 (mm). That is, the difference (A110−A104) between the predicted position indicated by a symbol A110 and the actual position indicated by a symbol A104 in FIG. 5 is 20 (mm).

If Ld is 0 mm, then the sheet transport speed is kept 300 (mm/S) as it is. Since Ld (20 (mm))>0, however, there is a delay in the transport of the sheet. To recover the delay, it is therefore necessary to determine an alternate speed Sc (mm/S) using the following expression and change to a higher speed. In addition, the following expression does not limit the scope of the present invention.

An example of calculation of an alternate speed to recover the delay Ld=(20 (mm)), where Alternate speed $Sc$ (mm/S)=set transport speed $Si$ (mm/S)/transport efficiency $k$, Transport efficiency $k$=substantial transport speed $Sr$ (mm/S)/set transport speed $Si$ (mm/S), and Substantial transport speed $Si$ (mm/S)=substantial transport length $Lm$ (mm)/elapsed time(first predetermined time)$T2$ (S).

An alternate speed Sc is determined from these expressions as follows:

Substantial transport speed $Sr$ (mm/S)=40/0.2=200,

Transport efficiency $k$=200/300≈0.67,

Alternate speed $Sc$ (mm/S)=300/0.67≈447.8.

The CPU 841 thus controls the sheet feeding motor M so that the pickup roller 504 and the sheet feeding roller 505*a* can transport the sheet at a sheet transport speed of 447.8 (mm/S). That is, as a straight line indicated by a symbol A103 in FIG. 5, the CPU 841 causes the sheet feeding motor M to rotate at a higher speed than before.

(The Case where a Sheet is Transported Too Far)

If the sheet is instead discharged earlier due to any variation in the position of the sheet P in the cassette, then Ld<0. In this case, however, it is instead necessary to reduce speed according to the above expression.

That is, an example of calculation of an alternate speed when the delay Ld is −20 (mm). That is, an example of calculation of an alternate speed when the actual position is a position indicated by a symbol A107 and precedes the predicted position indicated by a symbol A110 in FIG. 5 (A110–A107), where Alternate speed $Sc$ (mm/S)=set transport speed $Si$ (mm/S)/transport efficiency $k$, Transport efficiency $k$=substantial transport speed $Sr$ (mm/S)/set transport speed $Si$ (mm/S), and Substantial transport speed $Si$ (mm/S)=substantial transport length $Lm$ (mm)/elapsed time(first predetermined time)$T2$ (S).

An alternate speed Sc is determined from these expressions as follows:

Substantial transport speed $Sr$ (mm/S)=80/0.2=400,

Transport efficiency $k$=400/300≈1.33,

Alternate speed $Sc$ (mm/S)=300/1.33≈225.6.

The CPU 841 thus controls the sheet feeding motor M so that the pickup roller 504 and the sheet feeding roller 505*a* can transport the sheet at a sheet transport speed of 225.6 (mm/S). That is, as a straight line indicated by a symbol A108 in FIG. 5, the CPU 841 causes the sheet feeding motor M to rotate at a lower speed than before.

When the count value Cm of the counter 842 is less than a counter value Cr depending on the stop position before register (a position indicated by a symbol A109 in FIG. 5) serving as a predetermined position, the process waits for the sheet to advance (S108), and when the count value Cm exceeds the counter value Cr, the sheet feeding motor M is stopped to stop the sheet once (S109).

The process then waits a predetermined time T3 (see FIG. 5) (S110), which is 100 ms in the present embodiment. In addition, the predetermined time T plus the predetermined time T3 equals a second predetermined time T4. That is, the second predetermined time T4 is a time from the time when the sheet is discharged from the cassette 114 at a theoretical speed and is detected by the sheet feeding sensor 502 until the sheet reaches the paired resist rollers 150.

The CPU 841 controls the rotation of the sheet feeding motor M and sets the sheet transport speed of the paired sheet feeding rollers 505 to a speed St at which the toner image on the photoconductor drum 111 (see FIG. 8) is transferred on the sheet (S111). In the present embodiment, the speed St is 200 mm/s. The sheet is then discharged into the photoconductor drum 111 and the toner image is transferred on the sheet.

As described above, the sheet transport apparatus 101 controls the paired sheet feeding rollers 505 depending on the differences (A110–A104) and (A107–A110) between the predicted position A110 of the sheet and the actual positions A104 and A107 of the sheet so that the sheet reaches the stop position before register until the second predetermined time T4. The sheet transport apparatus 101 can thus increase the transport speed of the sheet when the sheet transport speed of the sheet feeding paired rollers 505 decrease (when the actual position is at A104). There is thus no waiting time of the sheet resulting from the conventional assumption that the sheet transport speed decreases and the sheet transport efficiency can be increased. Also, in the sheet transport apparatus, it is unnecessary to increase the transport speed of the sheet transport means at all times on the assumption that the sheet transport speed decreases. Vibrations can be thus reduced, thereby decreasing operation noise.

Further, if the sheet is discharged earlier due to any variation in the position of the sheet in the cassette 114 and the sheet advances too far, the sheet transport apparatus 101 slows down the rotation of the pickup roller 504 so that the sheet can reach the stop position before register until the second predetermined time T4. As a result, the rotation of the sheet feeding motor M can be slowed down, thereby decreasing noise.

Also, since the sheet transport apparatus 101 is adapted to increase the sheet transport speed of the paired sheet feeding rollers 505 only when the sheet transport speed decreases, it is unnecessary to keep the sheet transport speed high at all times unlike the conventional sheet transport apparatus and vibrations can be reduced, thereby decreasing operation noise.

Further, since the image forming apparatus 100 has the sheet transport apparatus 101 with reduced vibrations, any degradation of an image quality due to vibrations can be prevented and a high-quality image can be formed on the sheet.

In addition, the above-described embodiment illustrates a configuration in which the sheet transport speed is switched only once during the transport of the sheet to the stop position before register. The sheet transport speed may however be switched several times during the transport of the sheet to the stop position before register.

Figure 7:
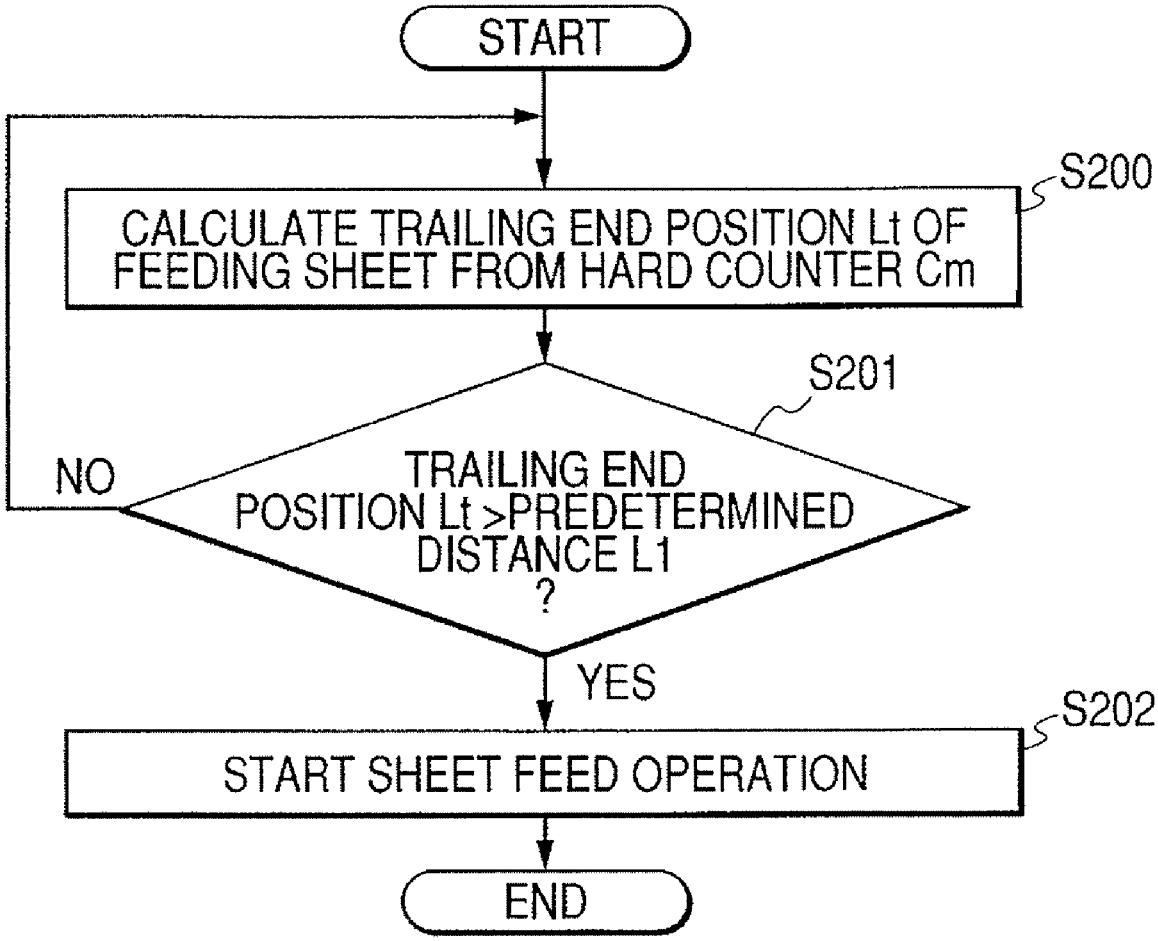
FIG. 7 is a flowchart for operational description when sheets are continuously transported in the sheet transport apparatus of the embodiment of the present invention.

FIG. 7 is a flowchart for illustrating the timing of starting transporting subsequent sheets when the sheet transport apparatus 101 continuously feeds sheets to the photoconductor drum 111.

The position of the trailing end Lt of the sheet being fed is determined from a count value Cm of the counter 842 and a length Lp of the sheet being fed with respect to the position of the sheet stored in the cassette 114 (S200).

The trailing end Lt is determined from the following expression:

$Lt$ (mm)=$Cm$×a length $Ld$ (mm) that the sheet advances during one pulse+the length $Lp$ (mm) of the sheet+a distance (mm) from the position of a recording member stored in the cassette to the rotary encoder 503.

The CPU 841 waits for the pickup roller 504 to discharge the sheet until the distance between the position of the leading end of a sheet in the cassette 114 to be discharged next and the trailing end of the sheet being fed is larger than a predetermined length Li (S201).

When Lt>Li, the CPU 841 then allows the pickup roller 504 to discharge the sheet (S202).

That is, the preceding sheet discharged by the pickup roller 504 serving as first sheet transport means that transports the sheet and the paired sheet feeding rollers 505 are detected by the sheet feeding sensor 502 serving as a sheet detecting sensor. The counter 842 (see FIG. 4) then starts counting the pulses of the rotary encoder 503 and the calculating circuit 848 calculates the actual position of the preceding sheet from the count pulse number (Cm) and the distance (Ld (mm)) that the sheet advances during one pulse.

The preceding sheet is also transported by a paired intermediate transport rollers 123 serving as second sheet transport means on the downstream side of the paired sheet feeding rollers 505. Meanwhile, the calculating circuit 848 is calculating the actual position of the preceding sheet. When the calculating circuit 848 calculates that the trailing end of the preceding sheet leaves the pickup roller 504 and the paired sheet feeding rollers 505, the CPU 841 serving as a control portion then causes both the rollers 504 and 505 to stop rotating.

The paired intermediate transport rollers 123 however continue to transport the preceding sheet and the rotary encoder 503 counts the movement of the preceding sheet. When the calculating circuit 848 calculates that the preceding sheet reaches such a position that the trailing end of the preceding sheet keeps a predetermined distance from the leading end of the subsequent sheet in the cassette 114, the CPU 841 then causes the pickup roller 504 and the paired sheet feeding rollers 505 to restart and discharge the subsequent sheet from the cassette 114.

Since the timing of discharging the subsequent sheet is determined based on the actual position of the trailing end of the preceding sheet, the sheet transport apparatus 101 ensures that the sheets can be transported at predetermined intervals without being affected by any slippage of the roller, an error of the timer that measures time and an error due to the delay of software processing unlike the conventional sheet transport apparatus.

Further, since the sheet transport apparatus 101 ensures that the sheets can be transported at predetermined intervals, the sheets can be transported at closer intervals than the conventional sheet transport apparatus, thereby increasing the sheet transport efficiency.

The image forming apparatus 100 has the sheet transport apparatus 101 that can transport the sheets at predetermined intervals. An image can therefore be formed accurately on a predetermined position on the sheet and any misalignment of the image can be prevented.

In addition, although the above-described sheet transport apparatus 101 is adapted to control the rotation speeds of both the pickup roller 504 and the paired sheet feeding rollers 505, the rotation speed of at least one of the rollers may be controlled. In this case, the other roller is rotated in accordance with the one roller.

In addition, although the pickup roller 504 and the like are illustrated as sheet transport means that transports a sheet, this is not exclusive. For example, sheet transport means in the form of a rotary belt may be used.

In the above-described embodiment, even if there is an error resulting from the fact that the actual position of a sheet is behind or ahead of a predicted position of the sheet when a first predetermined time T2 elapses after the sheet is detected by the sheet feeding sensor 502, the sheet transport speed is then changed to correct the error and the sheet can reach a predetermined stop position before register A109 after a second predetermined time T4. In the sheet transport apparatus according to the present embodiment, there is thus no need for assuming that a sheet transport speed of sheet transport means decreases as in the conventional embodiment. There is therefore no waiting time of the sheet resulting from the conventional assumption that the sheet transport speed decreases and the sheet transport efficiency can be increased.

In the sheet transport apparatus according to the above-described embodiment, it is unnecessary to increase the transport speed of the sheet transport means at all times on the assumption that the sheet transport speed decreases and vibrations can be thus reduced, thereby decreasing operation noise.

Since the image forming apparatus according to the above-described embodiment has a sheet transport apparatus with reduced vibrations, any degradation of an image quality due to vibrations can be prevented and a high-quality image can be formed on the sheet.

The sheet transport apparatus according to the above-described embodiment controls the sheet transport means depending on a difference between the actual position detected based on the rotation of the rotating member rotated by the sheet being transported and a predicted position based on the sheet transport speed of the sheet transport means. With this configuration, the transport position of the sheet transported by the sheet transport means can be more accurately controlled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-254190, filed Sep. 1, 2005, which is hereby incorporated by reference herein in its entirety.

What is claimed is:

1. A sheet transport apparatus, comprising:

a sheet transport unit that transports a sheet;

a sheet detecting unit that detects the sheet transported by the sheet transport unit;

a rotary member that contacts with the sheet being transported and is driven to rotate by the sheet transported by the sheet transport unit; and an actual position detecting unit that detects an actual position of the sheet when a predetermined time elapses after the sheet detecting unit detects the sheet based on a rotation amount of the rotary member rotated by the detected sheet; and a controller that controls a sheet transport speed of the sheet transport unit based on a difference between the actual position of the sheet detected by the actual position detecting unit and a predicted position calculated based on the sheet transport speed of the sheet transport unit and the predetermined time, wherein the controller controls the sheet transport unit so as to increase the sheet transport speed of the sheet transport unit when the actual position detected by the actual position detecting unit is upstream in a delivery direction of the predicted position, and so as to decrease the sheet transport speed of the sheet transport unit when the actual position detected by the actual position detecting unit is downstream in the delivery direction of the predicted position.

2. An image forming apparatus, comprising:

an image forming unit that forms an image on a sheet; and a sheet transport apparatus of claim 1 that transports the sheet to the image forming unit, wherein the controller controls so that the sheet arrives at the predetermined position upstream of the image forming unit at the predetermined time.

3. The sheet transport apparatus of claim 1, wherein the actual position detecting unit detects the actual position of the sheet based on the rotation amount of the rotary member rotated by the detected sheet from when the sheet detecting unit detects the sheet to when the predetermined time elapses.

4. The sheet transport apparatus of claim 3, further comprising:

an encoder that outputs pulses according to the rotation of the rotary member; and a counter that counts pulses outputted from the encoder.

5. The sheet transport apparatus of claim 3, wherein the controller calculates a ratio between a calculated sheet transport speed calculated depending on the signal which is outputted according to the rotation amount of the rotary member driven to rotate by the sheet being transported during the predetermined period is elapsed from when the sheet detecting unit detects the conveyed sheet conveyed by the sheet transport unit and a set sheet transport speed set to the sheet transporting unit during the predetermined period is elapsed from when the sheet detecting unit detects the sheet, and the controller determines a transporting speed of the sheet transport unit based on the calculate ratio so that the sheet reaches the predetermined position at the predetermined time.

6. The sheet transport apparatus of claim 3, wherein, the controller controls the sheet transport unit that transports a subsequent sheet so that an interval between a preceding sheet and the subsequent sheet becomes a predetermined interval depending on a signal which is outputted according to the rotation of the rotary member driven to rotate by the preceding sheet.

* * * * *